US006211783B1

(12) United States Patent
Wang

(10) Patent No.: US 6,211,783 B1
(45) Date of Patent: Apr. 3, 2001

(54) ACTION CONTROL PROCESS OF SECURITY ALARM SYSTEM

(76) Inventor: Randall Wang, 4978 Santa Anita Ave., Temple City, CA (US) 91780

( * ) Notice: Subject to any disclaimer, the term of this patent is extended or adjusted under 35 U.S.C. 154(b) by 0 days.

(21) Appl. No.: 09/567,572

(22) Filed: May 4, 2000

(51) Int. Cl.[7] ..... G08B 29/00
(52) U.S. Cl. ..... 340/506; 340/527; 340/565
(58) Field of Search ..... 340/506, 521, 340/527, 528, 529, 541, 545.1, 545.2, 545.3, 545.4, 545.8, 545.9, 552, 565, 825.06, 825.31

(56) References Cited

U.S. PATENT DOCUMENTS 5,532,680 * 7/1996 Ousborne ..... 340/567
5,640,141 * 6/1997 Myllymaki ..... 340/506
5,801,625 * 9/1998 Wang ..... 340/506

* cited by examiner

*Primary Examiner*—Van T. Trieu

(74) *Attorney, Agent, or Firm*—Raymond Y. Chan; David and Raymond Patent Group

(57) ABSTRACT

An action control process of a security alarm system is to render the general security alarm system to contain an auxiliary function of monitoring or detecting human activity within the monitoring area of the security alarm system, by utilizing the plurality of selected security devices selected from the security devices of the security alarm system during both armed or disarmed condition, without scarifying the original alarm protection functions. The action control process includes the steps of maintaining the plurality of selected security devices of the security alarm system in functioning condition when the security alarm system is set to a standby condition; computing a predetermined period of monitoring time; detecting any motion activity occurred inside at least a monitoring area by the selected security devices installed in the monitoring area during the predetermined period of monitoring time; resetting to compute the predetermined period of monitoring time initially again when a motion activity is detected by one of the selected security devices installed in the monitoring area within the predetermined period of monitoring time; detecting no motion activity in the monitoring area by any of the selected security devices after the predetermined period of monitoring time; and activating at least an alert device to perform an alert response.

20 Claims, 3 Drawing Sheets

ACTION CONTROL PROCESS OF SECURITY ALARM SYSTEM

BACKGROUND OF THE PRESENT INVENTION

The present invention relates to security alarm systems, and more particularly to an action control process of a security alarm system, which render the security alarm system to contain an auxiliary function of monitoring or detecting human activity within the monitoring area of the security alarm system, by means of the plurality of predetermined security devices of the security alarm system, such as motion sensors, opening contacts such as door/window switches, and carpet mat sensors, etc., during both armed or disarmed condition. The present invention renders the conventional security alarm system to also work as a fully automatically control lifeguard system for specific usages such as nurse call, patient protection, senior citizen safety control, on duty supervised, time/schedule control, energy saving, prisoner activity control, etc.

Most residences and facilities have installed security alarm systems to monitor the facilities from burglars or accidents. Conventional security alarm system, such as fire alarm system or burglary alarm system, generally comprises a control system such as an alarm control panel to control a plurality of security devices, such as motion detectors for detecting human action within the monitoring areas, window sensors for detecting any damage thereof, opening contacts such as door/window switches for detecting in and out of people, carpet mat sensors for detecting people walking thereon, and alert devices including communication devices such as voice dialer and/or digital dialer and audible and visual alarm devices for providing local alarm when burglar breaks in the monitoring area. Normally the conventional security alarm system is in disarming condition. The user can switch the security alarm system to an arming condition by setting a control keypad or a remote control of the control system to activate all the security devices before the user leaves. The user can switch off (disarmed) the alarm system by setting the control keypad or remote control when the user comes back.

The most common lifeguard security device for seniors and patients is a kind of manual alert device which comprises a push call button or a pull box that locates at a reachable position for the seniors and patients to call for immediate help when the senior or patient needs immediate help. However, he or she still needs to manually operate the push call button or pull box in order to call for emergency help. Therefore, if the senior or patient gets coma during sleeping or suddenly loses conscious, he or she has no way to call for help by himself or herself.

However, it is also very difficult to have a watch guard or security guard to monitor each of the senior residences, prisoners, patients or animals twenty-four hours a day in residences or facilities such as senior apartments, prisons, hospitals, and zoos, the only alternative way is to install video cameras at as many monitoring areas as possible and send the video information to those monitors in the control center so that one security guard can monitor more than one people or animal. However, such additional video camera and monitor system is very costly while each security guard can merely monitor a limited number of monitors at the same time. Besides, it is not practical to install video camera to monitor a senior's bedroom because of privacy.

SUMMARY OF THE PRESENT INVENTION

A first advantage of the present invention is to render the general security alarm system to contain an auxiliary function of monitoring or detecting human activity within the monitoring area of the security alarm system 24 hours a day, by utilizing a plurality of selected security devices of the security alarm system, such as motion sensors, opening contacts such as door/window switches, and carpet mat sensors.

A second advantage of the present invention is to render the conventional security alarm system to also work as a fully automatically control lifeguard system for specific usages such as nurse call, patient protection, senior citizen safety control, on duty supervised, time/schedule control, energy saving, prisoner activity control, etc, wherein when there is no action detected by any of the security devices installed in a particular monitoring area within a predetermined period of time, regardless whether the security alarm system is armed or disarmed, the alert devices of the security alarm system will be activated to respond correspondingly, such as dialing a phone call to the center station or triggering the local warning devices and/or audible and visual alarm devices to generate warning signals, etc.

Another advantage of the present invention is that the user does not need to independently install the expensive monitoring system, simply by connecting an action control device between a plurality of predetermined security devices and the input of the control system of a conventional security alarm system. The user can utilize the security devices and the alert devices of the security alarm system to achieve the lifeguard function without scarifying the original alarm protection functions.

Accordingly, in order to accomplish the above advantages, the present invention provides action control process of a security alarm system, which comprises the steps of:

(a) maintaining a plurality of selected security devices, such as motion sensors, of the security alarm system in functioning condition;

(b) computing a predetermined period of monitoring time;

(c) detecting any motion activity occurred inside at least a monitoring area by the selected security devices installed in the monitoring area during the predetermined period of monitoring time;

(d) resetting to compute the predetermined period of monitoring time initially again when a motion activity is detected by one of the selected security devices installed in the monitoring area within the predetermined period of monitoring time;

(e) detecting no motion activity in the monitoring area by any of the selected security devices after the predetermined period of monitoring time; and (f) activating at least an alert device to perform an alert response.

The action control process is especially suitable for the security alarm systems installed in senior apartments, prisons, hospitals, and etc. Generally, a human being even at sleep will move within a predetermined period of time, so that when there is no human action detected by the security devices of the security alarm system within the predetermined period of monitoring time, such as 1 hour to 24 hours selectably, an alert response will be activated to call for help or special care.

The action control process of the present invention further comprises the steps of stopping the computing of the predetermined period of monitoring time when the normally functioned security alarm system is fully set in an arming condition or manually disabled.

The above action control process is processed by incorporating an action control device between the plurality of selected security devices and the control system of the security alarm system, wherein the action control device comprises:

a time selector which is a time setting circuit for presetting a predetermined period of monitoring time;

a control processor unit, which comprises a timer counter and a processor, for picking signal from each of the selected security devices and processing the steps of computing the predetermined period of monitoring time preset in the time selector;

detecting any motion activity occurred inside at least a monitoring area by the selected security devices installed in the monitoring area during the predetermined period of monitoring time;

resetting to compute the predetermined period of monitoring time initially again when a motion activity is detected by one of the selected security devices installed in the monitoring area within the predetermined period of monitoring time;

detecting no motion activity in the monitoring area by any of the selected security devices after the predetermined period of monitoring time; and activating the alert device to perform an alert response;

a device input circuit for electrically connecting the selected security devices to the central processor unit for ensuring signals input to the central processor unit is readable and compatible with the central processor unit; and an output circuit for electrically connecting the central processor unit to the alert device for outputting action control response to the control system.

DETAILED DESCRIPTION OF THE PREFERRED EMBODIMENT

Figure 1:
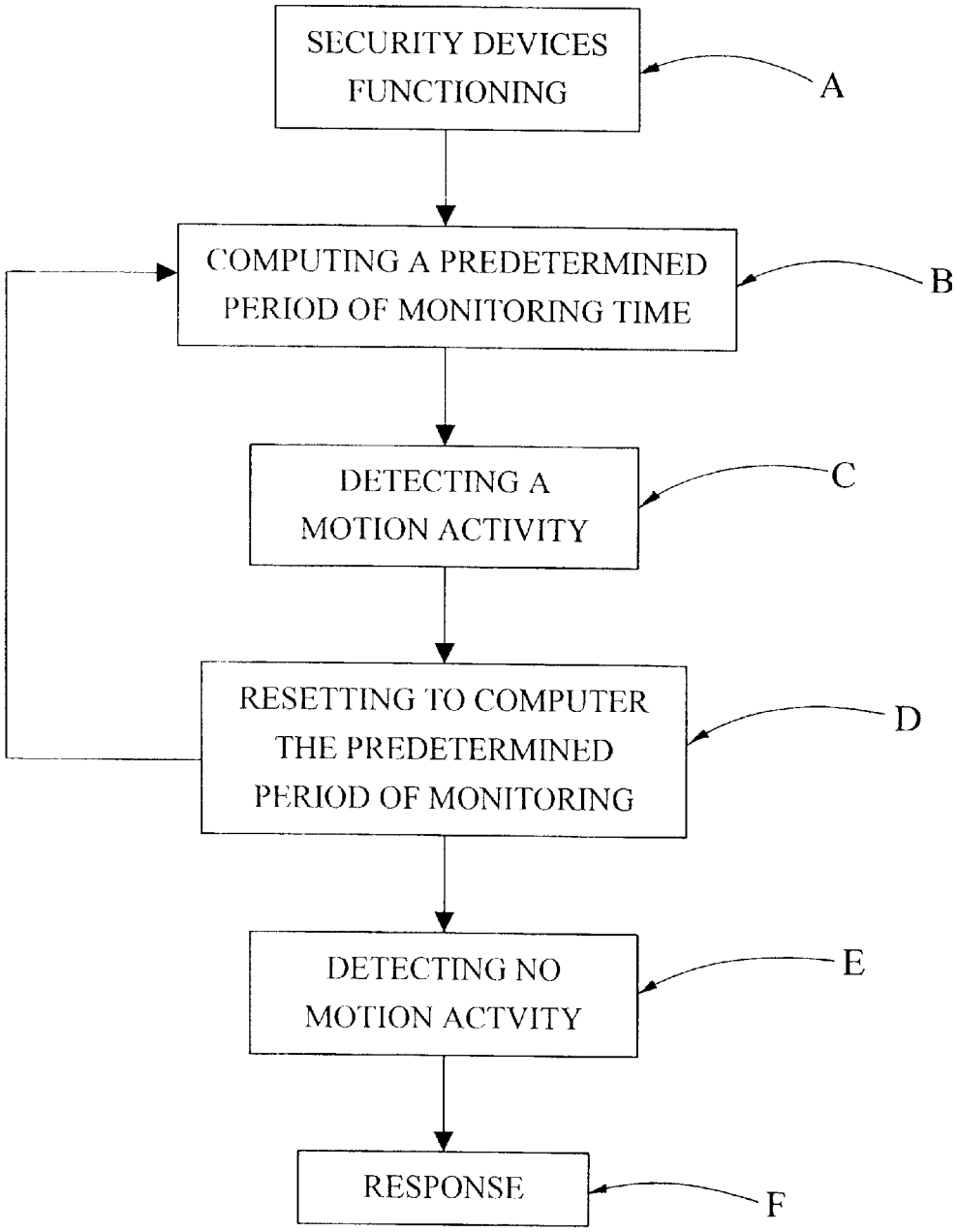
FIG. 1 is a block diagram of an action control process of a security alarm system according to a preferred embodiment of the present invention.
Figure 2:
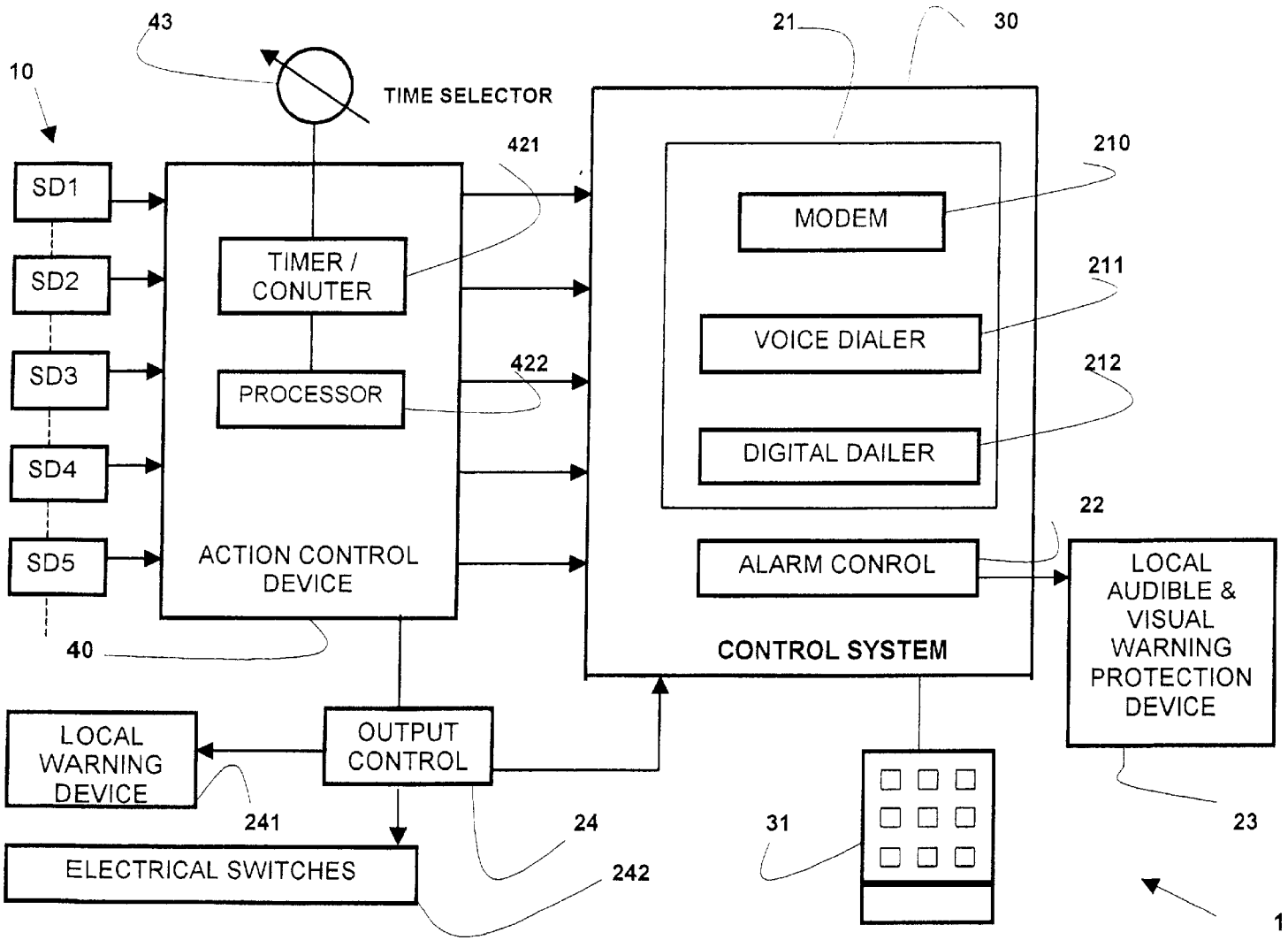
FIG. 2 is a block diagram illustrating the connection relationship between the action control device of the present invention and the security alarm system.

Referring to FIGS. 1 and 2, an action control process of a security alarm system, which is adapted for nurse call, patient protection, senior citizen safety control, on duty supervised, time/schedule control, energy saving, prisoner activity control, etc., is illustrated according to a preferred embodiment of the present invention.

The action control process comprises the following steps.

(A) Maintain a plurality of security devices 10 selected from the security devices of a security alarm system 1 in functioning condition 24 hours a day.

(B) Compute a predetermined period of monitoring time.

(C) Detect any motion activity occurred inside at least a monitoring area, such as family room, master bedroom, and hallway, by the selected security devices 10 installed in the monitoring area during the predetermined period of monitoring time.

(D) Reset to compute the predetermined period of monitoring time initially again when a motion activity is detected by one of the selected security devices 10 installed in the monitoring area within the predetermined period of monitoring time.

(E) Detect no motion activity in the monitoring area by any of the selected security devices after the predetermined period of monitoring time.

(F) Activate at least an alert device 20 to perform an alert response.

Referring to FIG. 2 of the drawings, according to the preferred embodiment of the present invention, an action control device 40 is installed between the control system 30 such as an alarm control panel and the plurality of selected security devices 10 of the security alarm system 1 arranged in a residence or facility, such as senior apartments, prisons, hospitals, and zoos, etc.

Generally, the selected security devices 10 include activity sensors such as opening contacts SD1 for doors and windows, carpet mat sensors SD2 for detecting people walking thereon, electric door switches SD3 for entrance and exit detection, and microphones SD4 for sound detection, and motion sensors SD5 such as passive infrared detectors, microwave detectors, ultrasonic detectors, laser beam detectors, and photo beam sensors, which are respectively installed to a plurality of predetermined monitoring areas of the residence or facility where motion activities of the monitoring human being or animal may occur.

Generally, the security alarm system 1 includes a plurality of alert devices 20 including communication devices 21 such as modem 210, voice dialer 211, and digital dialer 222, and an alarm control 22 for triggering local audible and visual warning protection devices 23, wherein the communication devices 21 and the alarm control 22 are generally built in the control system 30 of the security alarm system 1. Additionally, the action control device 40 may further include a local control 24 connected thereto acting as an additional alert device 20.

The action control process of the present invention is especially suitable for the security alarm systems installed in senior apartments, prisons, hospitals, and etc. Generally, a human being even at sleep will move within a certain period of time, such as 30 minutes to one hour. In other words, so that when there is no human action detected by the security devices 10 of the security alarm system within the predetermined period of monitoring time, such as 1 hour to 24 hours selectably, an alert response will be activated to call for help or special care.

It is well known that a conventional security alarm system 1 is normally in a disarming condition. The user can switch on the security alarm system 1 by setting a control keypad 31 or a remote control of the control system 30 to activate all its security devices, including the selected security devices 10, to function. It the user does not leave, i.e. to open and close one or more entrance/exit door, within a certain period of preset time, such as 30 seconds, the security alarm system is set to a partial arming condition. During the partial arming condition, the control system 30 does not function to activate the alert device 20 to respond when the motion sensor type security devices SD5 detect motion activity unless one of the security devices SD1 or SD3 for doors and windows detects a break-in action. Therefore, some senior residences like to switch on the security alarm system 1 to the partial arming condition even at home for safety purpose.

When the one or more entrance/exit door is detected to be opened and closed during the certain period of preset time, the security alarm system 1 is fully switched on to function in an arming condition. The user can switch off (disarmed)

the alarm system to the disarming condition by setting the control keypad or remote control during the partial arming condition or the arming condition after the user comes back.

In other words, the action control process functions during both the disarming condition and the partial arming condition of the security alarm system, wherein the action control device 40 is activated to function. Also, when the security alarm system 1 is fully set to the arming condition, the action control device 40 is automatically disabled to stop the computing of the predetermined period of monitoring time. Also, a manual switch can be installed to the action control device 40 so that the user can also disable it anytime, if necessary. It must be mentioned that the action control device 40 is connected between the security devices 10 and the control system 30 in such a manner that no matter the action control device 40 is normally functioned or disable, the security alarm system 1 is always working as usual.

Figure 3:
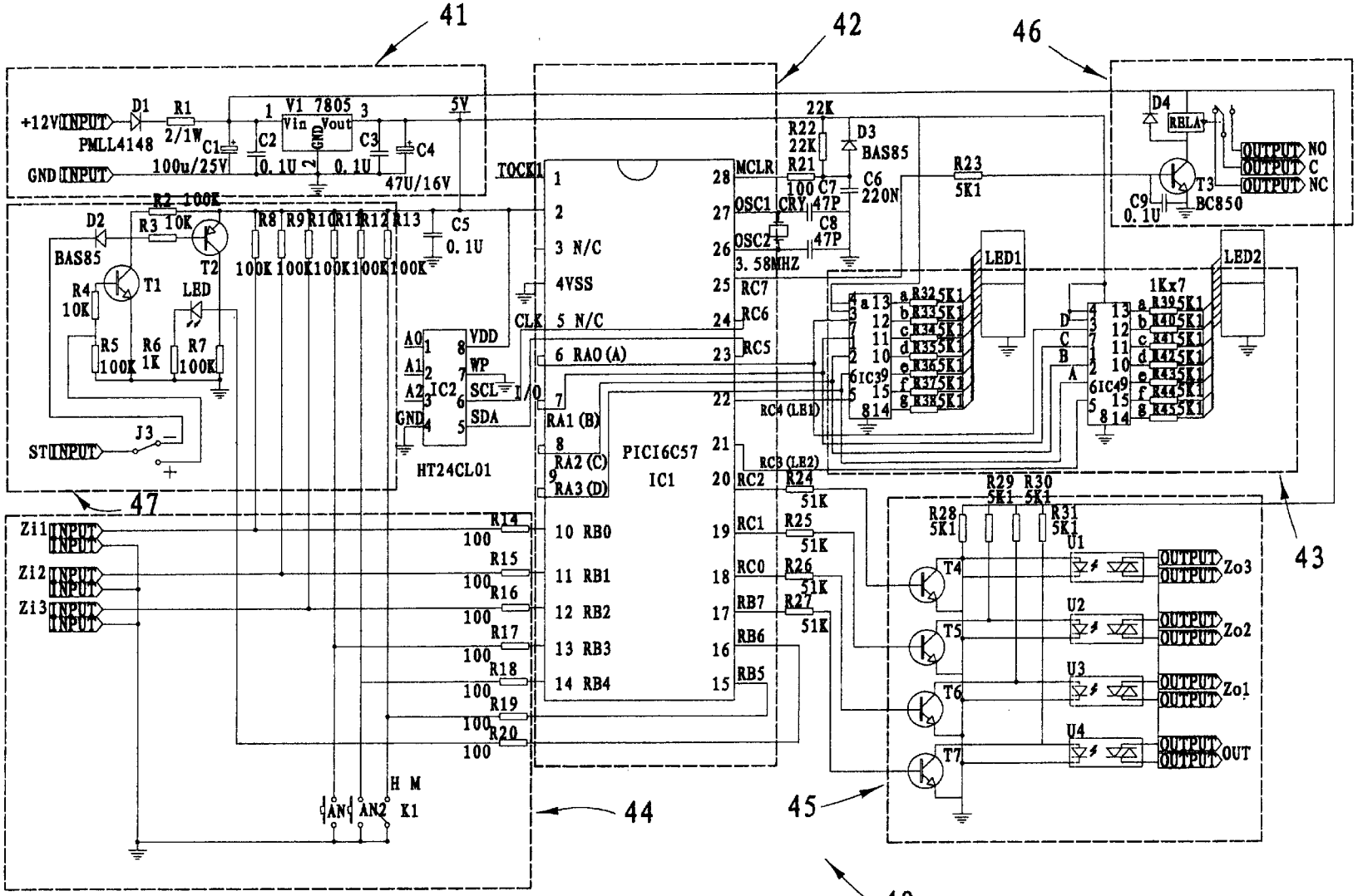
FIG. 3 is a circuit diagram of the action control device according to the preferred embodiment of the present invention.

As shown in FIGS. 2 and 3, the action control device 40 comprises a power supply circuit 41, a central processor unit (CPU) 42, a time setting circuit 43, a device input circuit 44, an output circuit 45, a relay output circuit 46, and a status control circuit 47.

The time selector 43 is a time setting circuit adapted for presetting the predetermined period of monitoring time in the step (b). The predetermined period of monitoring time can be selected from 1 hour to 99 hours, depending on where the action control process of the present invention is processed.

The device input circuit 44 is adapted for electrically connecting the selected security devices 10 to the CPU 42 for ensuring signals input to the CPU 42 is readable and compatible with the CPU 42. The output circuit 45 is adapted for electrically connecting the CPU 42 for outputting action control response to the respective alert devices 20, such as the local warning device 24, the communication device 21, and/or the alarm control 22 in the control system 30.

The CPU 42 comprises a timer counter 421 and a processor 422. There are two kinds of timer counter 421, wherein one is counting up from zero and the other one is counting down to zero. For example, if a predetermined period of monitoring time of 6 hours is set, a counting up timer counter will count from zero to 6 hours until it is reset in the step (D) to count from zero again. If a counting down timer counter is used, the predetermined period of monitoring time counts from 6 hours down to zero until it is reset in the step (D) to count from 6 hours again.

The processor 422 is adapted for picking signal sent from any of the security devices 10 and processing the above steps (b) to (f) of the present invention.

As mentioned above, the alert devices 20 may also include the local control 24 independently connected to the action control device 40 for triggering a local warning device 241 to produce local alarm signal and/or electrical switches 242 for controlling the power on/off of electrical appliances. The relay output circuit 46 is adapted for electrically connecting the local control 24 with the CPU 42 for activating the local control 24 for local alarm and other additional response such as energy saving purpose.

The status control circuit 47 is adapted for indicating the current status of the security alarm system, such as fully arming condition, partial arming condition and disarming condition, and whether the action control device is normally functioned or disabled.

In step (C), the motion activity includes any physical human or animal move detected by the motion sensors SD5 and the carpet mat sensors SD2, any open and close motion of the interior doors detected by the door and window opening contacts SD1 or door switches SD3, or any sound produced by the monitoring person or animal and detected by the microphones SD4.

In step (D), if the person or animal to be monitored stays within the monitoring area, the security alarm system 1 is generally in the disarming or partial arming condition, so that periodical or continuous motion activities will be detected by the selected security devices 10 of the security alarm system 1.

For example, a single senior or a patient to be monitored is sleeping and the predetermined period of monitoring time is set as 3 hours. Even though the senior or patient has been still for 15 minutes, the timer counter 421 counts from zero to 15 minutes. When one of the motion sensors SD5 in room detects his first movement, the timer counter 421 is reset to compute from initial again, such as zero. If the next movement of the senior or patient is 30 minutes later, the timer counter 421 will compute from zero to 30 minutes and then reset to zero again automatically after the next movement is detected. However, if the senior or patient has no movement detected more than 3 hours, he may be very sick or even losing conscious that needs immediate care. In steps (E) and (F), when the timer counter 421 computes from zero to 3 hours, the processor 422 of the action control device 40 will send a signal to the control system 30 to activate the respective alert device 20 for predetermined alert response. The alert devices 20 include but not limit to the communication device 21 and the alarm control 22. In which, as mentioned above, the communication device 21 includes modems 210, voice dialer 211, and digital dialer 212 for dialing phone call to user's home phone, beeper and/or cellular phone and/or predetermined location such as the security guard or doctor in control center, and other signal transmission equipments. The alert device 20 can also include the alarm control 22 connected to the local audible and visual warning protection device 23 for triggering siren to generate alert buzz and/or warning lamp to produce lighting.

When the security alarm system 1 is set to the fully arming condition, the action control device 40 is automatically disabled and the action control process does not function too. All the selected security devices 10 function with the control system 30 normally like directly connecting to the control system 30 as usual, i.e. the control system 30 will trigger the respective alert devices 20 to produce alarm signal when any motion is detected by anyone of the selected security devices 10.

In view of above, since facilities like senior apartments, prisons, hospitals, and zoos are provided with security alarm system for security and safety purposes, by processing the action control process of the present invention, the installed security alarm system can perform an additional function of monitoring human or animal activities 24 hours a day within the monitoring area of the security alarm system 1, so as to provide immediate, adequate reactions and responses when there is no motion detected from the old seniors, patients, prisoners or animals. Another advantage of the present invention is energy saving usage that the security alarm system of an office structure can also be processed to turn off designated electrical appliances such as air conditioners and coffee machines when no human activity is detected within a predetermined period of time.

Most of the conventional security alarm systems are well developed to detect any possible action. In other words, basically the existing security alarm system is supposed to be designed specifically to detect all possible motion within the monitoring area by means of cross detection. It is a lot better and more efficient than any conventional single detector. The present invention takes advantage of the existing security alarm system by equipping the existing security alarm system with the action control device 40 to provide an unexpected extra function for the security alarm system.

What is claimed is:

1. An action control process of a security alarm system comprising a control system, a plurality of security devices connected to said control system providing with at least an alert device, wherein said action control process comprises the steps of:

(a) maintaining a plurality of selected security devices selected from said security devices of said security alarm system in functioning condition;

(b) computing a predetermined period of monitoring time;

(c) detecting any motion activity occurred inside at least a monitoring area by said selected security devices installed in the monitoring area during said predetermined period of monitoring time;

(d) resetting to compute said predetermined period of monitoring time initially again when a motion activity is detected by one of said selected security devices installed in said monitoring area within said predetermined period of monitoring time;

(e) detecting no motion activity in said monitoring area by any of said selected security devices after said predetermined period of monitoring time; and (f) activating said alert device to perform an alert response.

2. The action control process, as recited in claim 1, wherein said selected security devices include a plurality of motion and activity sensors.

3. The action control process, as recited in claim 2, wherein said security devices include opening contacts for doors and windows, carpet mat sensors, electric door switches, and microphones for sound detection, passive infrared detectors, microwave detectors, ultrasonic detectors, laser beam detectors, and photo beam sensors.

4. The action control process, as recited in claim 1, wherein said action control process is processed during a disarming condition of said security alarm system when said security alarm system is switched off.

5. The action control process, as recited in claim 4, wherein said action control process is also processed during a partial arming condition of said security alarm system, wherein said security alarm system is switched on by an user to activate all said security devices to function but said user does not leave by opening and closing an entrance/exit door within a certain period of preset time.

6. The action control process, as recited in claim 1, further comprising a step of stopping the computing of said predetermined period of monitoring time automatically upon said security alarm system is set to a fully arming condition.

7. The action control process, as recited in claim 2, further comprising a step of stopping the computing of said predetermined period of monitoring time automatically upon said security alarm system is set to a fully arming condition.

8. The action control process, as recited in claim 3, further comprising a step of stopping the computing of said predetermined period of monitoring time automatically upon said security alarm system is set to a fully arming condition.

9. The action control process, as recited in claim 4, further comprising a step of stopping the computing of said predetermined period of monitoring time automatically upon said security alarm system is set to a fully arming condition.

10. The action control process, as recited in claim 5, further comprising a step of stopping the computing of said predetermined period of monitoring time automatically upon said security alarm system is set to a fully arming condition.

11. The action control process, as recited in claim 1, wherein said alert device includes a communication device for dialing phone call to predetermined location and an alarm control for triggering a local audible and visual warning protection device.

12. The action control process, as recited in claim 5, wherein said alert device includes a communication device for dialing phone call to predetermined location and an alarm control for triggering a local audible and visual warning protection device.

13. The action control process, as recited in claim 10, wherein said alert device includes a communication device for dialing phone call to predetermined location and an alarm control for triggering a local audible and visual warning protection device.

14. An action control device electrically connected between a plurality of selected security devices selecting from all security devices of a security alarm system and a control system of said security alarm system which provides at least an alert device, wherein said action control device comprises:

a time selector which is a time setting circuit for presetting a predetermined period of monitoring time;

a control processor unit, which comprises a timer counter and a processor, for picking signal from each of said selected security devices and processing the steps of computing said predetermined period of monitoring time preset in said time selector;

detecting any motion activity occurred inside at least a monitoring area by said selected security devices installed in said monitoring area during said predetermined period of monitoring time;

resetting to compute said predetermined period of monitoring time initially again when a motion activity is detected by one of said selected security devices installed in said monitoring area within said predetermined period of monitoring time;

detecting no motion activity in said monitoring area by any of said selected security devices after said predetermined period of monitoring time; and activating said alert device to perform an alert response;

a device input circuit for electrically connecting said selected security devices to said central processor unit for ensuring signals input to said central processor unit is readable and compatible with said central processor unit; and an output circuit for electrically connecting said central processor unit to said alert device for outputting action control response to said control system.

15. The action control device, as recited in claim 14, further comprising a local control independently connected to said central processor unit via a relay output circuit for producing action control response.

16. The action control device, as recited in claim 14, further comprising a status control circuit for indicating whether said security alarm system is fully arming condition, partial arming condition or disarming condition and whether said action control device is normally functioned or disabled.

17. The action control device, as recited in claim 15, further comprising a status control circuit for indicating whether said security alarm system is fully arming condition, partial arming condition or disarming condition and whether said action control device is normally functioned or disabled.

18. The action control device, as recited in claim 14, wherein said predetermined period of monitoring time is selected from 1 hour to 99 hours.

19. The action control device, as recited in claim 14, wherein said predetermined period of monitoring time is counting up from zero to a predetermined time by said time counter.

20. The action control device, as recited in claim 14, wherein said predetermined period of monitoring time is counting down from a predetermined time to zero by said time counter.

* * * * *